US005224366A

United States Patent [19]

Huang

[11] Patent Number: 5,224,366

[45] Date of Patent: Jul. 6, 1993

[54] KEY RING ASSEMBLY

[76] Inventor: Yu-Hwei Huang, 1/F., No. 5, Alley 2, Lane 85, Min-Tsu Rd., Lu-chou Hsiang, Taipei Hsien, Taiwan

[21] Appl. No.: 828,101

[22] Filed: Jan. 30, 1992

[51] Int. Cl.[5] ..... A44B 15/00

[52] U.S. Cl. ..... 70/456 R; 70/459

[58] Field of Search ..... 70/456 R, 456 B, 457–459; 206/37.1–37.8, 38.1; 24/3 K

[56] References Cited

U.S. PATENT DOCUMENTS

| | | | |
|---|---|---|---|
| 3,257,696 | 6/1966 | Miller et al. | 70/456 R |
| 3,608,343 | 9/1971 | Kimel | 70/456 R |
| 4,584,858 | 4/1986 | Wolter | 70/456 R |
| 4,592,219 | 6/1986 | Richter | 70/456 R |
| 4,776,191 | 10/1988 | MacDonald | 70/459 |
| 5,031,430 | 7/1991 | Nelson | 70/459 |
| 5,050,414 | 9/1991 | Huang | 70/456 R |

FOREIGN PATENT DOCUMENTS

| | | | |
|---|---|---|---|
| 720198 | 10/1965 | Canada | 70/456 R |
| 3017803 | 12/1980 | Fed. Rep. of Germany | 24/3 K |
| 2572262 | 5/1986 | France | 70/456 R |
| 2026311 | 1/1980 | United Kingdom | 70/456 R |

*Primary Examiner*—Renee S. Luebke
*Assistant Examiner*—D. M. Boucher

[57] ABSTRACT

A key ring assembly comprised of a key ring holder made from a circular casing having two opposite shoulders with a T-shaped sliding way invertedly defined around a peripheral wall thereof, a key ring connector secured to said key ring holder for holding a key ring, said key ring connector having an expanded head inserted through a notch on one shoulder above said T-shaped sliding way, a control knob for controlling a sliding rod in opening or closing said notch for inserting or disconnecting said key ring connector.

3 Claims, 2 Drawing Sheets

KEY RING ASSEMBLY

BACKGROUND OF THE INVENTION

The present invention relates to key ring assemblies and relates more particularly to a key ring assembly for holding a bunch of keys which is easy to assemble and durable in use.

For holding a bunch of keys, a key ring or key ring assembly may be used. Conventionally, a key ring is simply made from a spring or iron wire through the process of bending. For comfortably holding a key ring in the hand, a key ring holder may be used, and therefore several key ring assemblies have been disclosed for this purpose. According to one known structure, a key ring assembly is generally comprised of a key ring holder having a key ring secured thereto by a connecting rod, which connecting rod is inserted through a hole and is slidable along a sliding way on the peripheral wall of the key ring holder, which hole is controlled to open and close by a stop rod and a push rod. In the aforesaid structure of key ring assembly, the stop rod is secured to the push rod through a screw joint. Because the stop rod and the push rod are connected through a screw joint, the threads thereof may be damaged easily causing connection failure.

SUMMARY OF THE INVENTION

The present invention has been accomplished to eliminate the aforesaid problem. According to the present invention, there is provided a key ring assembly which is generally comprised of a key ring holder made from a circular casing having two opposite shoulders with an inverted T-shaped sliding way defined around a peripheral wall thereof, at least one key ring connector secured to the key ring holder for holding a key ring each, which key ring connector has an expanded head inserted through a notch on one shoulder above the sliding way, and a control knob for controlling a sliding rod in opening or closing the notch for inserting or disconnecting the key ring connector. The control knob has an expanded end inserted through a key hole on the key ring holder into a pivot hole on the sliding rod and retained by a plunger which is supported on a spring and inserted in a bottom hole on the bottom end of the sliding rod.

DETAILED DESCRIPTION OF THE PREFERRED EMBODIMENTS

Figure 3:
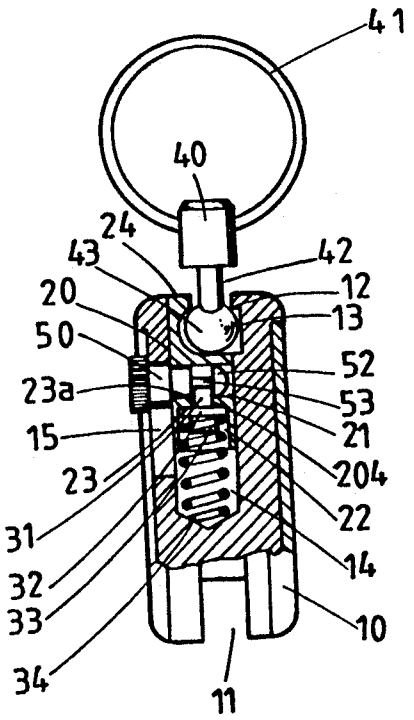
FIG. 3 is a cross section taken on line III—III of FIG. 1.
Figure 2:
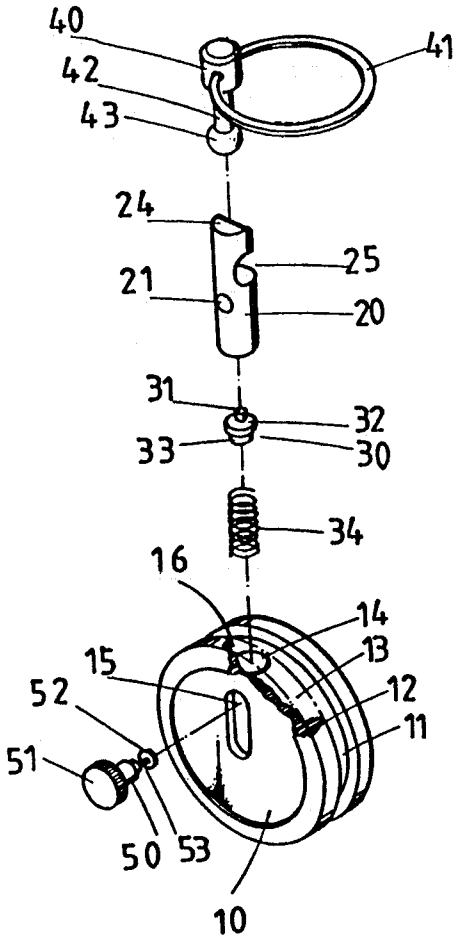
FIG. 2 is an exploded view of the key ring assembly of FIG. 1.
Figure 1:
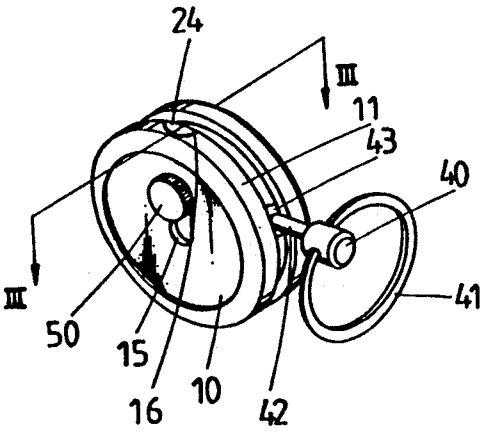
FIG. 1 is an elevational view of a key ring assembly embodying the present invention.

Referring to FIGS. 1, 2 and 3, a key ring assembly is generally comprised of a ring 41 secured to a key ring holder 10 by a connecting rod 40, a sliding rod 20, a plunger 30 and a spring 34, and controlled by a control knob 50 for holding a bunch of keys.

The key ring holder 10 is formed of a hollow, circular casing comprising an circular recess 11 around the peripheral wall thereof, two shoulders 12 around the two opposite peripheral edges thereof bilaterally spaced above said circular recess 11 permitting said circular recess 11 to be divided into a narrow, intermediate sliding way 13 and two wider, opposite side sliding ways (the two wider, opposite side sliding ways are respectively protected by the shoulders 12), a hole 14 on said circular recess 11 at a suitable location for inserting the sliding rod 20, a notch 16 on either shoulder 12 above said hole 14, and a key hole 15 on a side wall thereof in communication with said hole 14 for fastening the control knob 50.

The sliding rod 20 has a pivot hole 21 on the peripheral surface thereof at a suitable location, a bottom hole 22 on a bottom edge thereof (see FIG. 3), a division wall 23 inside said bottom hole 22, defining a center hole 23*a* on said division wall 23 in communication with said pivot hole 21, a top projection 24 longitudinally aligned at one end, and a curved notch 25 formed on said top projection 24.

The plunger 30 is inserted into the bottom hole 22 on the sliding rod 20 and is comprised of a top rod 31 at one end inserted into the center hole 23*a* on the division wall 23 of the sliding rod 20, a bottom rod 33 at an opposite end supported on the spring 34, and a collar 32 stopped between the division wall 23 and the spring 34.

The ring 41 is fastened in a hole (not shown) on the connecting rod 40. The connecting rod 40 has a spherical head 43 at one end of the elongated rod body 42 thereof. By inserting the spherical head 43 into the notch 16 on one shoulder 12 of the key ring holder 10 and moving it sideways, the spherical head 43 can be retained between the two shoulders 12 of the key ring holder 10 and may slide along the narrow, intermediate sliding way 13.

The control knob 50 is comprised of a neck portion 53 at one end terminated into an expanded head 52, and a knob 51 at an opposite end. The knob 51 is relatively bigger than the key hole 15 so that it will be stopped at the outside after the insertion of the neck portion 53 into the key hole 15. By inserting the expanded head 52 of the control knob 50 through the key hole 15 on the key ring holder 10 into the pivot hole 21 on the sliding rod 20, the top rod 31 of the plunger 30 is forced to engage in the neck portion 53.

Because the outer diameter of the spherical head 43 is wider than the width of the intermediate sliding way 13 on the key ring holder 10 (wider than the gap between the two shoulders 12), sliding the connecting rod 40 along the intermediate sliding way 13 does not cause the connecting rod 40 to disconnect from the key ring holder 10. Therefore, the ring 41 is firmly secured to the key ring holder 10 for holding a bunch of keys.

Disconnecting the connecting rod 40 from the key ring holder 10 is easy and outlined hereinafter. Pressing down the control knob 50 to carry the sliding rod 20 downwards causing the spring 34 to be compressed by the sliding rod 20. Therefore, the top projection 24 of the sliding rod 20 is released from the notch 16 on one shoulder 12. Once the top projection 24 of the sliding rod 20 is moved downward from notch 16, the notch 16 becomes opened, and therefore, the spherical head 43 of the connecting rod 40 can be removed from the key ring holder 10 through the notch 16. As soon as the downward pressure has been released from the control knob 50, the sliding rod 20 is automatically moved back by the spring 34 to block up the notch 16 again. By pressing down the control knob 50, the connecting rod 40 can be inserted into the notch 16 and secured to the key ring holder 10 again.

Figure 6:
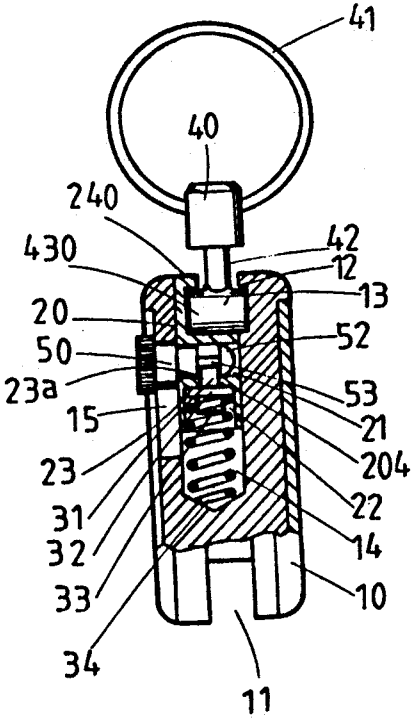
FIG. 6 is a cross section taken on line VI—VI of FIG. 4.
Figure 5:
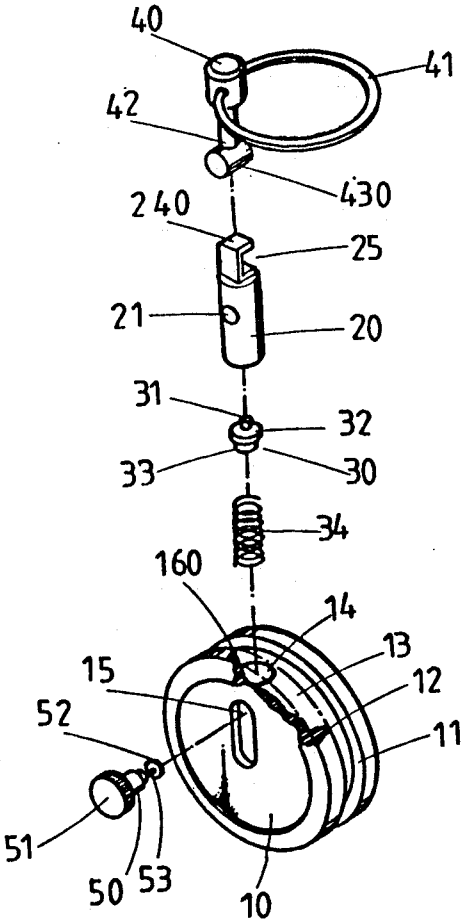
FIG. 5 is an exploded view of the key ring assembly of FIG. 4.
Figure 4:
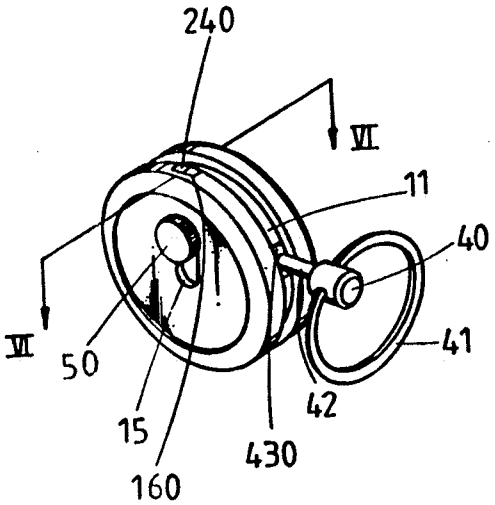
FIG. 4 is an elevational view of an alternate form of the present invention.

Referring to FIGS. 4, 5 and 6, therein illustrated is an alternate form of the present invention. In this embodiment, the key ring holder 10, the plunger 30, the spring 34 and the control knob 50 are identical, while some changes are made on the connecting rod 40 and the sliding rod 20. As illustrated, the connecting rod 40 has a cylindrical transverse rod 430 (instead of the spherical head 43 on the aforesaid first embodiment of the present invention) at one end inserted through a rectangular notch 160 on one shoulder 12 and secured to the key ring holder 10 between the two shoulders 12. The sliding rod 20 has a angle plate 240 instead of the top projection 24 on the aforesaid first embodiment of the present invention. The operation of this alternate form of king ring assembly is similar to the aforesaid first embodiment of the present invention.

What is claimed is:

1. A key ring assembly for holding a bunch of keys, comprising:

a) a key ring holder, said key ring holder being formed of a hollow, circular casing defining a sliding way around a peripheral wall thereof, two opposite shoulders around said peripheral wall at opposite sides spaced above said sliding way, a hole defined in said sliding way, a first notch defined on one shoulder and located above said hole, and a key hole defined on a side wall thereof in communication with said hole;

a sliding rod movably fastened in said hole on said sliding way, said sliding rod having a pivot hole extending through a peripheral surface thereof and a top projection defining a second notch;

spring means operatively associated with the sliding rod to bias the sliding rod to a closed position wherein the top projection blocks said first notch and wherein said second notch is in alignment with the sliding way;

at least one connecting rod for connecting key rings to said key ring holder, said connecting rod having an expanded head at one end inserted through said first notch and configured so as to be retained between said two opposite shoulders and to be slidable along said sliding way through said second notch;

a control knob inserted through said key hole into said pivot hole in said sliding rod such that movement of the control knob moves said sliding rod; and wherein said control knob comprises a reduced dimension neck portion inserted into the pivot hole of the sliding rod and wherein said spring means comprises a plunger and a spring, said plunger having: a top rod extending from one end inserted through a center hole defined by a division wall on said sliding rod so as to enter the neck portion of the control knob to secure said control knob in place; a bottom rod supported on said spring; and a collar between said top rod and said bottom rod and wherein moving said control knob downwards causes said top projection of said sliding rod to open said first notch for passing through the first notch said expanded head of said connecting rod and wherein releasing said control knob causes said top projection of said sliding rod to be pushed upwards by said spring means to block said first notch and said second notch to be aligned with the sliding way such that the connecting rod can be moved completely around the peripheral wall of the key ring holder.

2. The key ring assembly of claim 1, wherein said expanded head of said connecting rod is formed as a spherical shape, and wherein said first and second notches have a generally circular shapes for inserting said expanded head of said connecting rod.

3. The key ring assembly of claim 1, wherein said expanded head of said connecting rod is formed as a cylindrical transverse rod, and wherein said first and second notches have generally rectangular shapes for inserting said expanded head of said connecting rod.

* * * * *